US008376877B1

(12) United States Patent
Galloway

(10) Patent No.: US 8,376,877 B1
(45) Date of Patent: Feb. 19, 2013

(54) METHOD AND GOLF CLUB

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 538 days.

(21) Appl. No.: 12/629,525

(22) Filed: Dec. 2, 2009

Related U.S. Application Data

(66) Substitute for application No. 61/120,753, filed on Dec. 8, 2008.

(51) Int. Cl.
*A63B 53/04* (2006.01)

(52) U.S. Cl. ..... 473/330; 473/342; 473/349

(58) Field of Classification Search ..... 473/324–350
See application file for complete search history.

(56) References Cited

U.S. PATENT DOCUMENTS 4,027,885 A 6/1977 Rogers
4,077,632 A 3/1978 Taylor
4,558,505 A 12/1985 Moore
4,768,787 A 9/1988 Shira
5,354,059 A 10/1994 Stuff
5,487,543 A 1/1996 Funk
5,626,948 A * 5/1997 Ferber et al. ..... 428/195.1
5,800,285 A * 9/1998 Thorne et al. ..... 473/324
5,853,894 A * 12/1998 Brown ..... 428/422
6,012,989 A * 1/2000 Saksun, Sr. ..... 473/341
6,059,670 A 5/2000 Mogan
6,152,833 A * 11/2000 Werner et al. ..... 473/324
6,193,615 B1 2/2001 Hirota
6,254,958 B1 * 7/2001 Yoshida et al. ..... 428/64.2
6,276,266 B1 * 8/2001 Dietz et al. ..... 101/41
6,314,880 B1 * 11/2001 Lampinski ..... 101/170
6,354,962 B1 * 3/2002 Galloway et al. ..... 473/342
6,381,828 B1 * 5/2002 Boyce et al. ..... 29/527.4
6,425,831 B1 * 7/2002 Heene et al. ..... 473/332
6,440,011 B1 * 8/2002 Hocknell et al. ..... 473/342
6,443,856 B1 9/2002 Galloway et al.
6,663,496 B2 * 12/2003 Cameron et al. ..... 473/220
6,837,799 B2 * 1/2005 Cameron et al. ..... 473/221
6,981,923 B2 * 1/2006 Chappell ..... 473/330
7,018,418 B2 * 3/2006 Amrich et al. ..... 623/23.5
7,056,226 B2 * 6/2006 Kennedy ..... 473/330
7,179,175 B2 2/2007 Kennedy, III
7,258,627 B2 * 8/2007 Chappell ..... 473/331
7,278,928 B2 * 10/2007 Newman et al. ..... 473/342
7,452,283 B2 11/2008 Hettinger et al.
7,473,187 B2 1/2009 Vokey et al.
7,568,983 B2 * 8/2009 Gilbert ..... 473/330
7,780,549 B2 * 8/2010 Park et al. ..... 473/331
8,172,697 B2 * 5/2012 Cackett et al. ..... 473/329

* cited by examiner

*Primary Examiner* — Alvin Hunter
(74) *Attorney, Agent, or Firm* — Michael A. Catania; Rebecca Hanovice; Sonia Lari

(57) ABSTRACT

A method for creating a face of a golf club head with a preferred surface texture is disclosed herein. The method includes etching a non-scoreline portion of a face using a photosensitive coating that is activated with light to etch the face. The scorelines are protected from the etching process to maintain the well-defined geometries of the face.

8 Claims, 6 Drawing Sheets

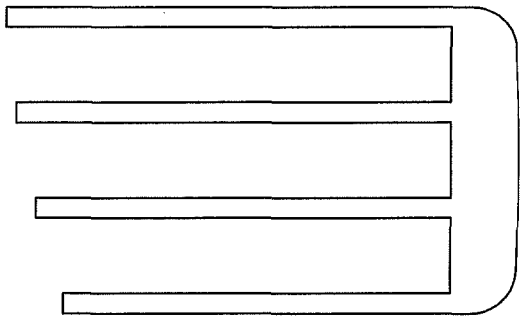
FIG. 4
FIG. 5
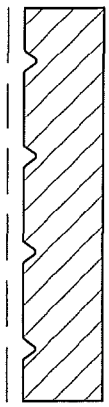
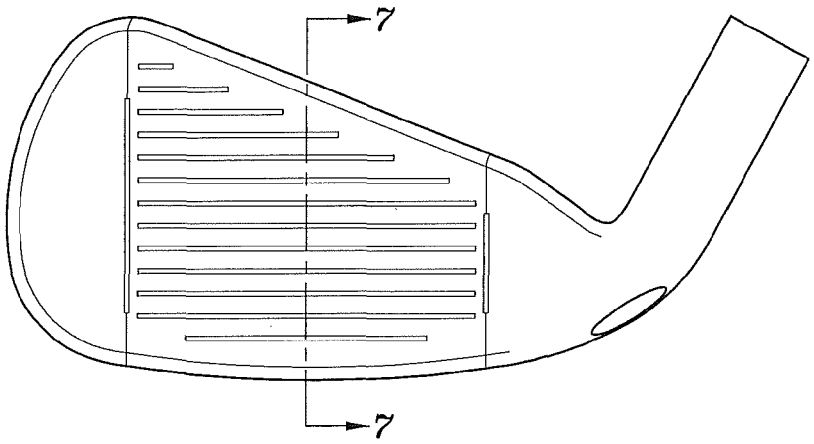
FIG. 6

METHOD AND GOLF CLUB

CROSS REFERENCES TO RELATED APPLICATIONS

The present application claims priority to U.S. Provisional Patent Application No. 61/120,753, filed on Dec. 8, 2008.

STATEMENT REGARDING FEDERALLY SPONSORED RESEARCH OR DEVELOPMENT

Not Applicable

BACKGROUND OF THE INVENTION

1. Field of the Invention

The present invention relates to a method for creating the face of a golf club.

2. Description of the Related Art

The roughing and flattening of a golf club iron can disrupt the geometry of the score line and this disruption, under the equipment rules of golf, cause a violation of the rules of golf.

The best performance is obtained when the full opportunities for detailing the surface under the rules are available. Grinding, milling and knurling of the face will have to be performed between the best score line geometries to simultaneously achieve the best performance and to avoid altering the score line geometries such that the geometries are then counter to the governing rules and/or are less effective.

The prior art discloses various methods to manufacture golf club heads, especially iron-type golf club heads. For example, Rogers, U.S. Pat. No. 4,027,885 for Golf Iron Manufacture, discloses scoring grooves into a face for the club head.

Taylor, U.S. Pat. No. 4,077,632 for a Lined Face For A Golf Club discloses grooves in compliance with the Rules of Golf at that time.

Moore, U.S. Pat. No. 4,558,505, for a Method Of Making Weighted Metal Golf Club Head discloses at process for making an iron-type golf club head.

Shira, U.S. Pat. No. 4,768,787, for a Golf Club Including High Friction Striking Face discloses grit blasting the horizontal grooves to provide a friction generating surface when the striking surface of the golf club head engages a ball.

Stuff, U.S. Pat. No. 5,354,059, for Golf Club Heads With Means For Imparting Corrective Action, discloses a club head with at least two non-parallel sets of grooves.

Funk, U.S. Pat. No. 5,487,543, for a Shot Peened Golf Club Head, discloses shot peening the striking surface of a golf club head.

Mogan, U.S. Pat. No. 6,059,670, for a Golf Club Having A Head With A Hard Multilayer Striking Surface And Method For Making The Same, discloses manufacturing a club head by heat treatments, vacuum treatments, and roughening.

Doolen, U.S. Pat. No. 6,179,725, for a Golf Club Having Angular Grooves discloses grooves oriented at various angles.

Hirota, U.S. Pat. No. 6,193,615, for a Head Of Golf Clubs That Spins More, discloses a face having grooves that allow for pressure to act specially on the edges of the grooves to increase ball spin.

Vokey et al, U.S. Pat. No. 7,473,187, for Spin Milled Grooves For A Golf Club, discloses machining grooves into a face.

Hettinger et al., U.S. Pat. No. 7,452,283, for a Putterhead With Dual Milled Face Pattern, discloses milling grooves into a face of a putter.

Kennedy, III, U.S. Pat. No. 7,179,175, for a Golf Club Having Stepped Grooves, discloses a golf club head with V-shaped and U-shaped grooves.

Scoreline designs generally have a cross-section geometry that includes two edges, two side walls and a bottom. The side walls are at a predetermined angle from a vertical line. Usually, each wall has more than one section and those sections are straight or curved. Alternatively, the scoreline design is a "V" shape, in which case there is no bottom other than a vertex or fillet radius.

The following requirements apply to apply to the collective set of scorelines, grooves, on any individual club head. Groove width (W) is measured per the USGA 30° method. Less than 50% of groove widths shall be greater than 0.035 inch and no single groove width shall be greater than 0.037 inch. Groove widths shall not vary by more than 0.010 inch from narrowest to widest. Groove depth (D) is measured per the USGA method from adjoining land areas. Less than 50% of groove depths shall be greater than 0.020 inch and no single groove depths shall be greater than 0.022 inch. Groove depths shall not vary by more than 0.010 inch from shallowest to deepest. Groove spacing (S) is measured per the USGA 30° method. Less than 50% of groove spaces shall be less than 0.075 inch or be less than three times the width of the widest amount adjacent groove. No single groove space shall be less than 0.073 inch or be less than three times the width of the widest adjacent groove minus 0.008 inch.

BRIEF SUMMARY OF THE INVENTION

The present invention seeks to selectively remove material from a golf club face to achieve the preferred texture for the surface. Further the method of the present invention allows accurate and rapid masking of areas not to be modified. The purpose of the process is to maintain score lines and other features in their approved geometry, but to allow the disruption of the surface away from the score line geometry. The present invention overcomes the difficulty of mechanically altering the surface texture between the score lines of a golf club face.

The present invention can be applied to the golf club face after or before the addition of the score lines. The present invention allows the application of roughening and texture after the score lines have been created in the face. In this invention, a photo-sensitive coating is applied to the face plate on the surface, sufficiently away from the score line, such that the precise geometry of the score lines is maintained. Light is projected onto the face plate to expose it. The plates are then washed to stop the etching action after the desired details are achieved.

The present invention can also be used after the flattening of the face surface of irons and before the creation of the score lines. There may also be a need to spade the texture of the face away from the score lines to allow the creation of the correct geometry.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 4 is an illustration of a mask for scorelines in practicing the present invention.

FIG. 5 is a cross-sectional view of scorelines of a golf club head illustrating relief at the scorelines by using a photosensitive etch applied by pad printing.

FIG. 6 is a front view of a golf club head illustrating scorelines.

DETAILED DESCRIPTION OF THE INVENTION

Figure 1:
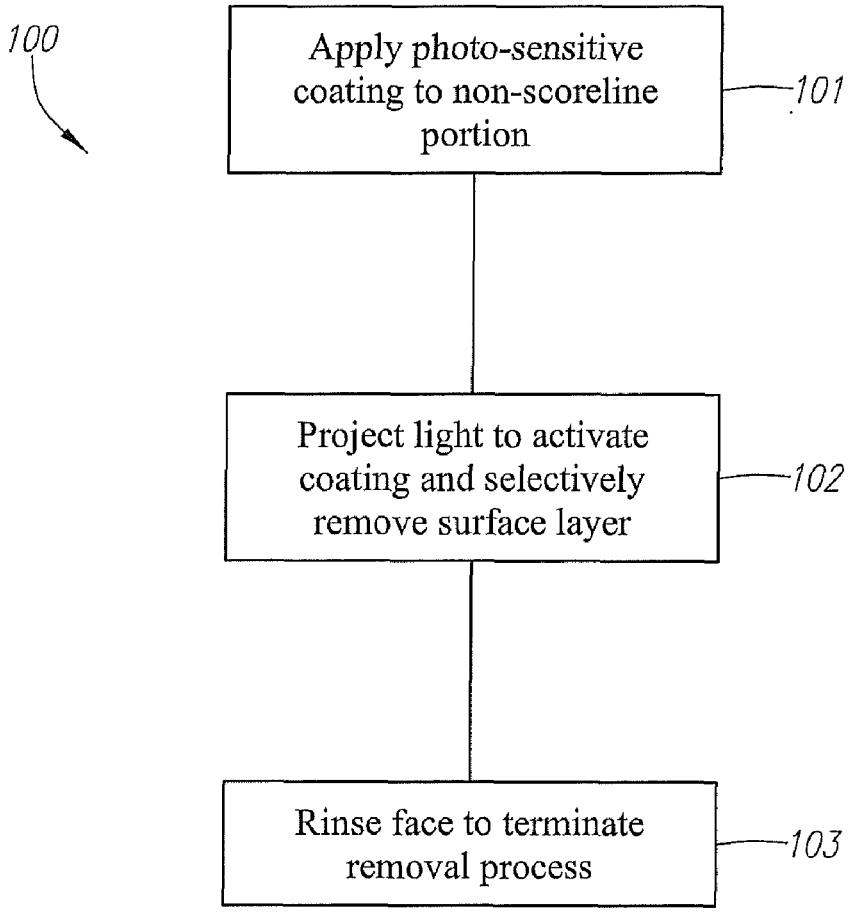
FIG. 1 a flow chart of the method of the present invention.

The present invention comprises a method for selectively removing surface material from the face of a golf club. The method for forming a golf club head 20 is illustrated in FIG. 1 and generally designated 100. The method comprises applying a photosensitive coating to a non-scoreline 24 portion of a face 22 of a golf club head 101 and projecting light on the face to activate photosensitive coating to selectively remove surface material from the face of the golf club head 102. The face 22 of the golf club head is then rinsed to terminate the surface material removal process 103.

The scorelines 26 are preferably that of an iron-type golf club head 20 or a driver-type golf club head 20. Alternatively, the scorelines 26 are stepped. The golf club head 20 is preferably composed of a stainless steel material or a titanium alloy material.

Figure 2:
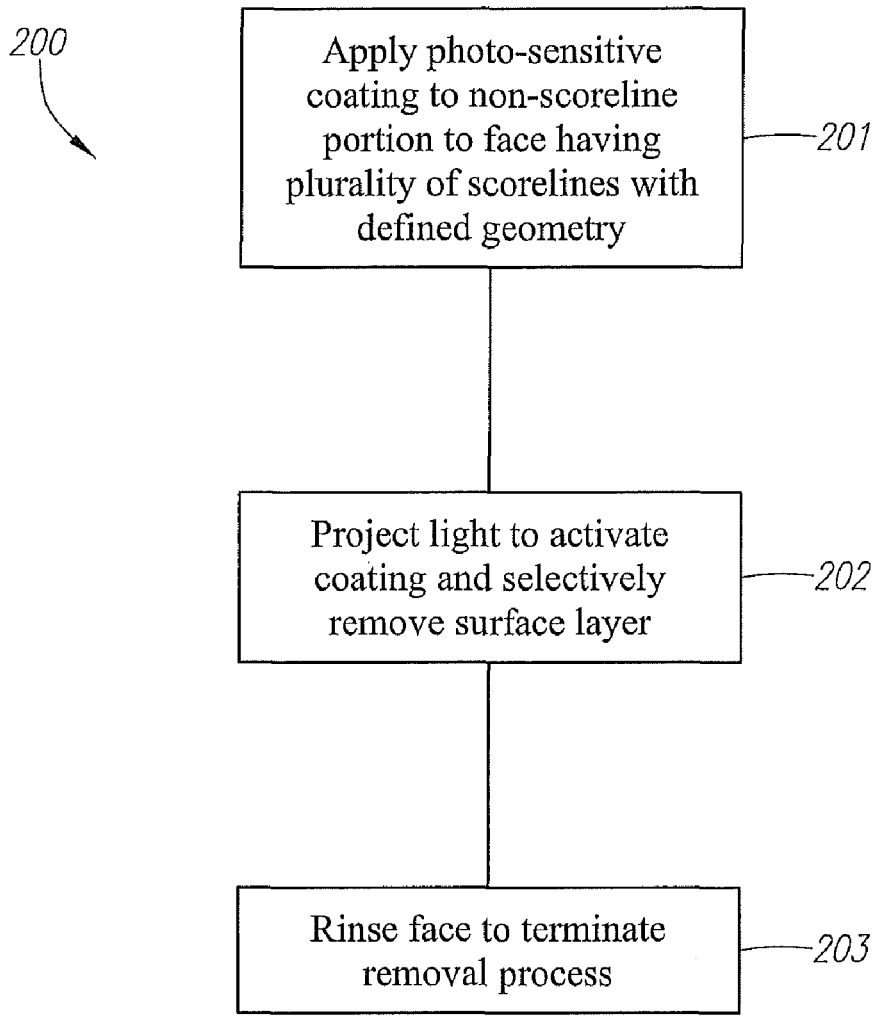
FIG. 2 is a flow chart of an alternative method of the present invention.

The second method for forming a golf club head 20 of the present invention is illustrated in FIG. 2 and generally designated 200. This method of the present invention involves applying a photosensitive coating to a non-scoreline portion 24 of a face 22 of a golf club head 20, the face 22 having a plurality of scorelines 26 with defined geometries 201. Light is projected on the face 22 to activate the photosensitive coating to allow removal of surface material and the golf club head 202. The face of the golf club head 20 is then rinsed to terminate the surface material removal process 203.

The face 22 of the golf club head 20 preferably has an area ranging from 2.0 square inches to 10 square inches. A mask is applied to the face 22 prior to applying the photosensitive coating. The photosensitive coating may be applied by various methods, including pad printing.

Figure 3:
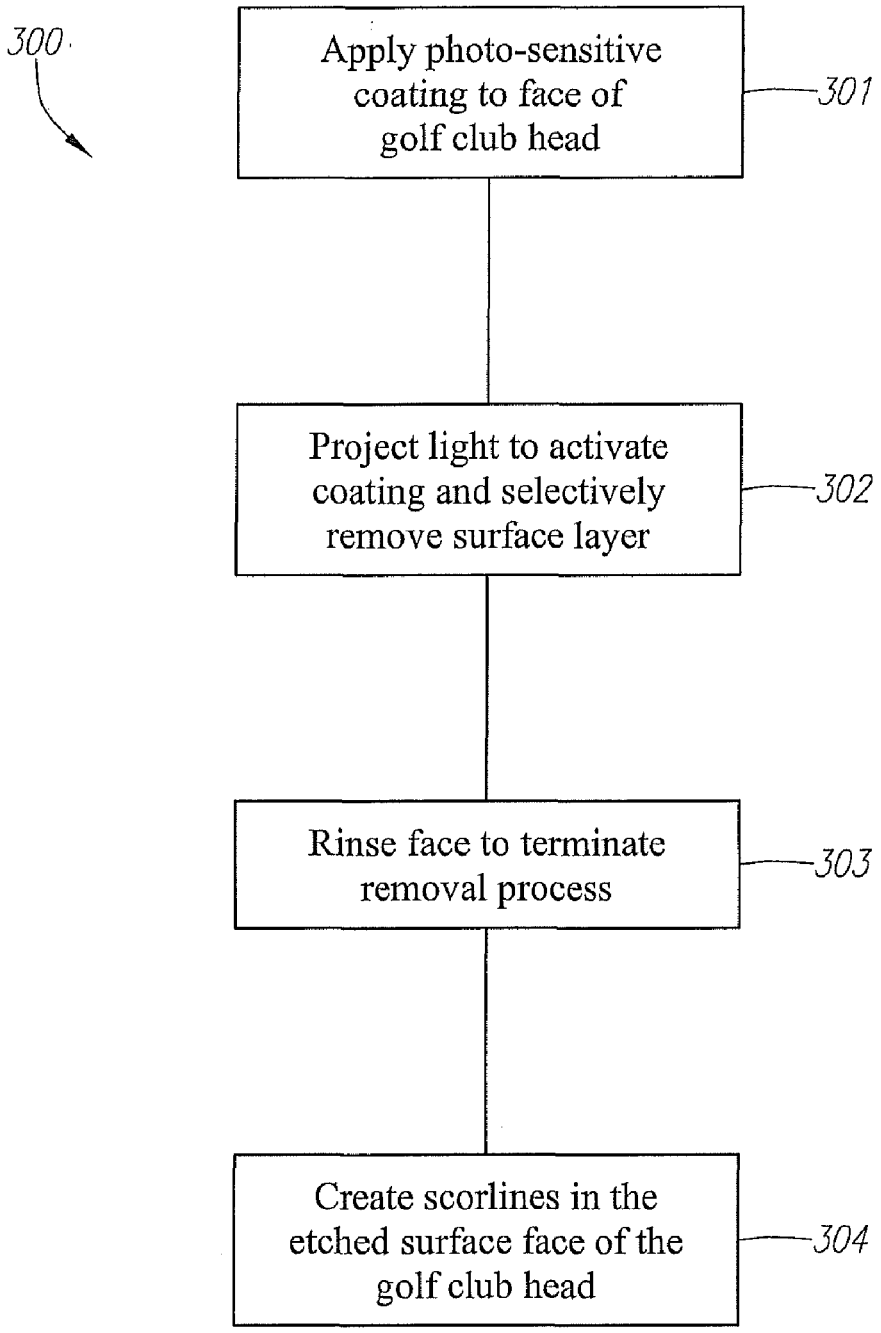
FIG. 3 is a flow chart of an alternative method of the present invention.

The third method of the present invention is illustrated in FIG. 3 and is generally designated 300. This method comprises applying a photosensitive coating to a face 22 of a golf club head 301 and projecting light on the face to activate photosensitive coating to selectively remove surface material from the face 22 of the golf club head 302. The golf club head 20 is then rinsed to terminate the surface material removal process and create and etched face 303. Scorelines 26 are then created in the etched surface of the golf club head 304.

As shown in FIG. 4, a mask 28 is illustrated for protecting scorelines of a golf club head 20. Such precise scoreline geometries are disclosed in U.S. Pat. No. 6,443,856 for Contoured Scorlines For The Face Of A Golf Club and U.S. Pat. No. 7,179,175 for Golf Club Head Having Stepped Grooves, both of which are hereby incorporated by reference.

Figure 7:
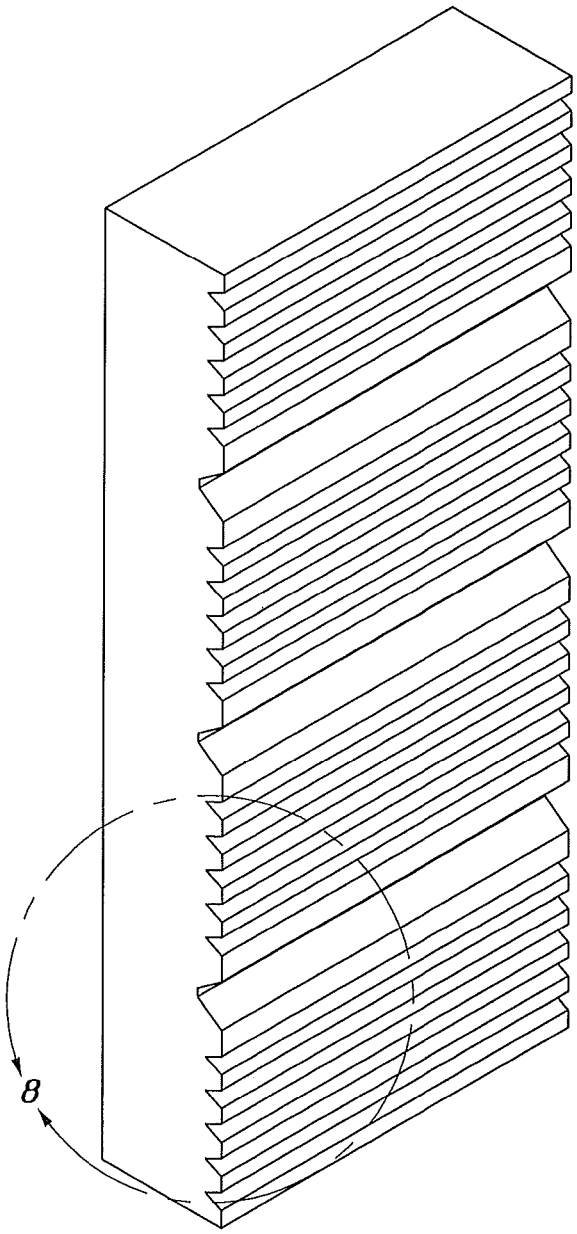
FIG. 7 is a cross-sectional view of scorelines of a golf club head undergoing the process of the present invention.
Figure 8:
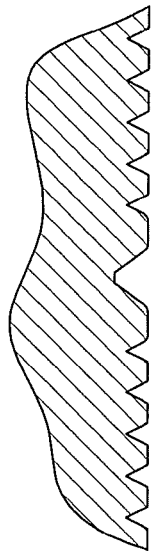
FIG. 8 is an isolated view of circle 8 of FIG. 7.

Alternatively, as shown in FIG. 5, a photo-sensitive etch is applied to a golf club head 20 using pad printing 30. Photo-etching involves the application of a photo-sensitive coating to light sensitive polymer plates. Light is then projected on the plate as a negative image which exposes it. The recess of the scorelines prevent the photo-sensitive etch from being applied to the scorelines 26. As shown in FIGS. 6-8, the etching process involves the areas outside of the scorelines 26. The scorelines 26, including the transition area to the surface having curved edges, is left untouched by the etching process.

Figure 9:
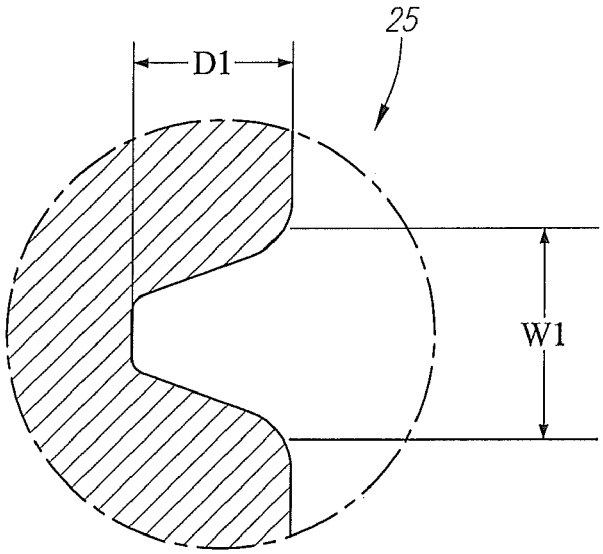
FIG. 9 is an isolated and enlarged cross-sectional view of a groove.
Figure 10:
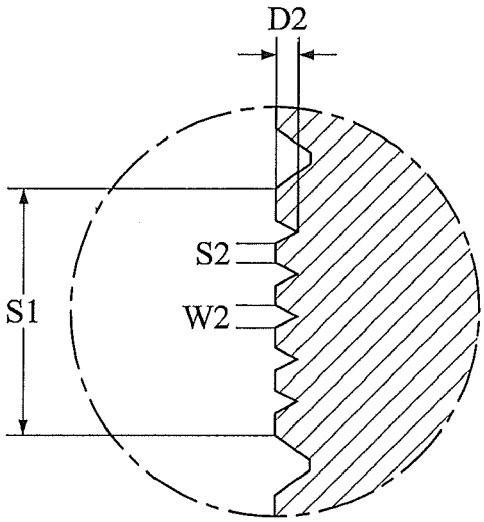
FIG. 10 is an isolated and enlarged cross-sectional view of grooves on a face of a golf club head.

The method of the present invention may be employed on a face 22 having one set of a plurality of grooves 25 of equal width (W), depth (D) and spacing (S). Alternatively, it is used on a face 22 with both a first and second set of a plurality of grooves 25, the second set being micro grooves having a smaller width (W), depth (D), and spacing (S). As shown in FIG. 9, a groove 25 of the first set of plurality of grooves 25 has a width, W1, preferably ranging from 0.024 inch to 0.030 inch. The width is defined as the distance across a groove 25 from an inflection point of one end to an inflection point of the opposing end. Also, as shown in FIG. 9, a groove of the first set of plurality of grooves has a depth (D1) of at least 0.010 inch. Further, as shown in FIG. 10, a distance between grooves 25 is the spacing (S1) and each of the first plurality of grooves is spaced at least 0.1 inch from any other of the first plurality of grooves and is preferably between 0.075 inch and 0.11 inch. The distance (P) from the center of the groove (25) in the first set of plurality of grooves to the adjacent groove of the first set of grooves preferably ranges from 0.102 inch to 0.142 inch.

As shown in FIG. 10, each of the grooves 25 of the second set of plurality of grooves has a depth (D2) of less than 0.001 inch. A groove 25 of the second set of plurality of grooves has a width, W2, preferably ranging from 0.001 inch to 0.010 inch. Further, as shown in FIG. 10 the spacing (S2) between each of the second plurality of grooves is spaced no more than 0.002 inch from an adjacent second plurality of grooves.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A method for selectively removing surface material from the face of a golf club, the method comprising:

applying a photosensitive coating to a non-scoreline portion of a face of a golf club head, the face having a plurality of scorelines, each of the plurality of scorelines having a defined scoreline geometry;

projecting light on the face to activate the photosensitive coating to selectively remove surface material from the face of the golf club head and maintain the defined scoreline geometry of each of the plurality of scorelines; and rinsing the face of the golf club head to terminate the surface material removal process.

2. The method according to claim 1 wherein the golf club head is an iron-type golf club head.

3. The method according to claim 1 wherein the golf club head is composed of a stainless steel material.

4. The method according to claim 1 wherein the golf club head is composed of a titanium alloy material.

5. The method according to claim 1 wherein the face of the golf club head has an area ranging from 2.0 square inches to 10 square inches.

6. The method according to claim 1 wherein a mask is applied to the face prior to applying the photosensitive coating.

7. The method according to claim 1 wherein pad printing is used to apply photosensitive coating.

8. A method for selectively removing surface material from the face of a golf club, the method comprising:

applying a photosensitive coating to a non-scoreline portion of a face of a golf club head, the face having a plurality of scorelines with defined scoreline geometries;

projecting light on the face to activate photosensitive coating to selectively remove surface material from the face of the golf club head and maintain the defined scoreline geometries of each of the plurality of scorelines; and rinsing the face of the golf club head to terminate the surface material removal process.

* * * * *